United States Patent [19]

Suttles

[11] Patent Number: 4,881,660

[45] Date of Patent: Nov. 21, 1989

[54] JUMBO CUP DISPENSER

[75] Inventor: J. Marshall Suttles, Elberton, Ga.

[73] Assignee: Royston Corporation, Royston, Ga.

[21] Appl. No.: 189,847

[22] Filed: May 3, 1988

[51] Int. Cl.[4] ..... A47F 1/04

[52] U.S. Cl. ..... 221/44; 221/59; 221/304

[58] Field of Search ..... 221/304, 303, 310, 44, 221/33, 241, 221, 297, 56, 59, 63, 307, 308, 309; 312/43, 71

[56] References Cited

U.S. PATENT DOCUMENTS

| | | | |
|---|---|---|---|
| 1,660,247 | 2/1928 | Wooten et al. | 221/221 |
| 2,877,403 | 3/1959 | Bennett | 221/44 |
| 3,163,323 | 12/1964 | Behrens et al. | 221/4 |
| 3,581,934 | 6/1971 | Sciascia | 221/304 |
| 3,790,023 | 2/1974 | Filipowicz | 221/304 |
| 3,795,344 | 3/1974 | Falk et al. | 221/241 X |
| 4,126,248 | 11/1978 | House | 221/241 |
| 4,234,101 | 11/1980 | Pastore | 221/304 X |
| 4,658,983 | 4/1987 | Suttles | 221/304 X |

FOREIGN PATENT DOCUMENTS

| | | | |
|---|---|---|---|
| 241237A1 | 12/1986 | German Democratic Rep. | 221/297 |
| 2169886A | 7/1986 | United Kingdom | 221/294 |

*Primary Examiner*—Joseph J. Rolla
*Assistant Examiner*—Stephen B. Parker
*Attorney, Agent, or Firm*—Howson & Howson

[57] ABSTRACT

An adjustable dispenser for holding and dispensing various size cups including the so-called jumbo cup. Radially adjustable retainers within a flanged storage tube frictionally hold the rim of the forwardmost cup against discharging until manually pulled out. Each retainer is locked in a serrated surface within the flange by a thumbscrew.

12 Claims, 3 Drawing Sheets

FIG. 1
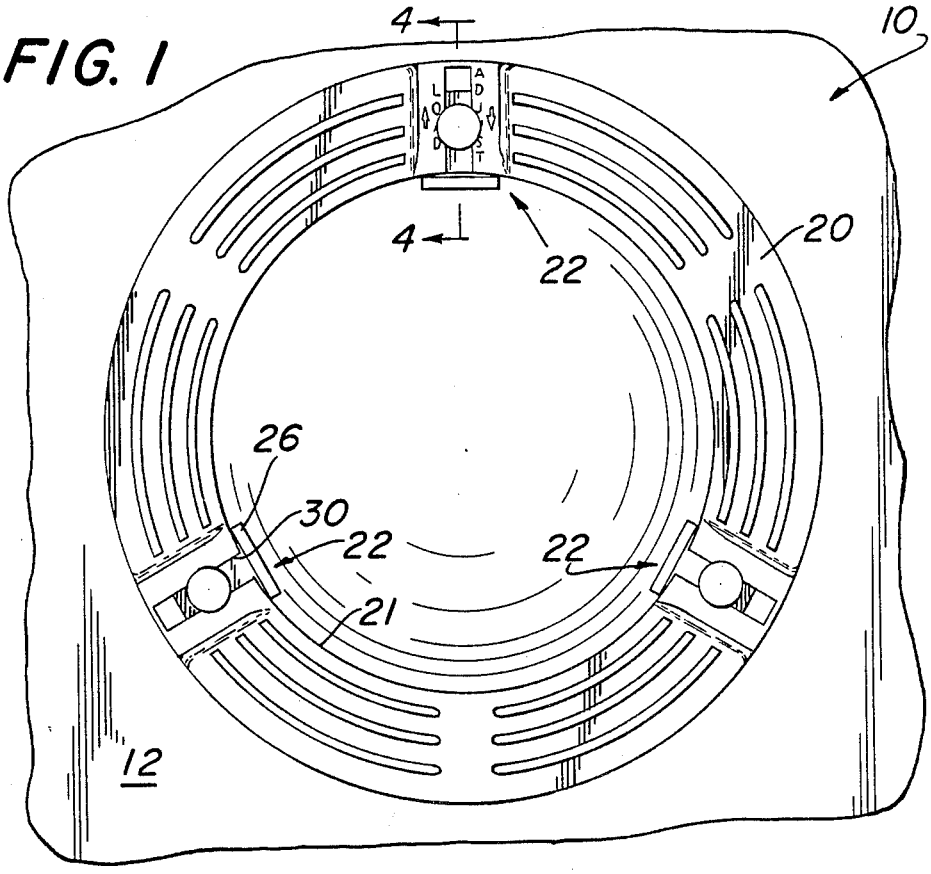
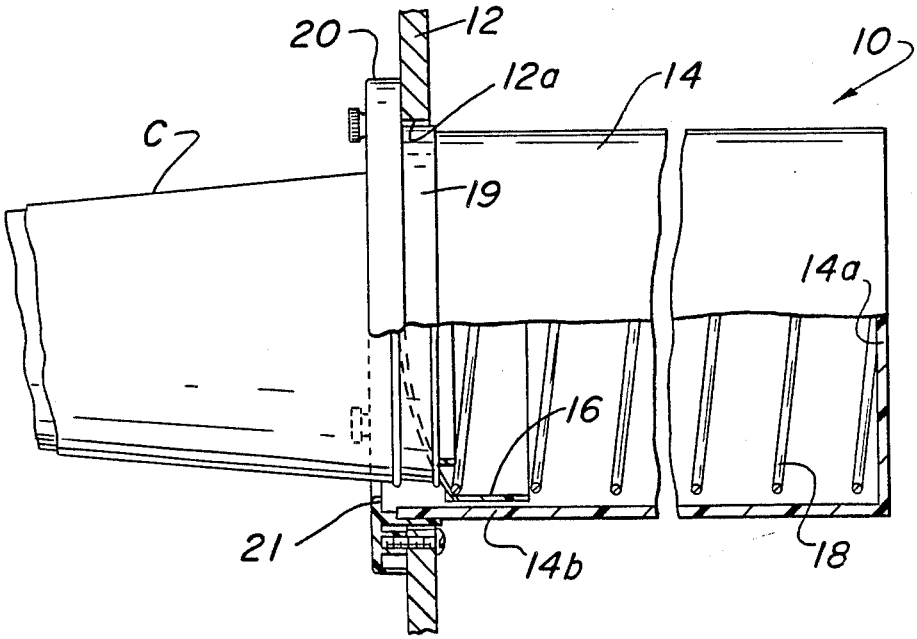
FIG. 2

JUMBO CUP DISPENSER

BACKGROUND OF THE INVENTION

The present invention relates to article dispensing, and more particularly to an adjustable dispenser for holding and dispensing various sizes of plastic or paper cups and the like, including the new jumbo size, stacked therewithin.

Dispensers designed to store and dispense stacked plastic or paper conical cups are well known in the prior art. For example, radial projections or retainers located in the discharge opening of the dispenser frictonally engage the rim of the first cup of an inverted stack. As the first cup is stripped off the stack, the weight of the cups or a spring behind the stack pushes the remaining cups outwards until the rim of the next cup frictionally engages the retainers. The retainers can be adjusted in or out of the opening to accommodate different cup sizes, but the adjustment is not usually accessible at the discharge end or front of the container. Therefore, when the dispenser is flush-mounted in an enclosure or panel, it must be removed to adjust for another size of cup. My prior U.S. Pat. No. 4,658,983, issued Apr. 21, 1987, provides an extremely simple and inexpensive mechanism accessible on the front of the dispenser for adjusting, with the fingers, leaf-spring type retainers which extend to the front from within the storage tube. However, the retainers project into the storage tube and preclude the dispenser's use for a new extra large or so-called jumbo cup series without enlarging the tube. Larger tubes are logistically undesirable as they would entail additional inventory over and above that for existing tubes which are still in use, and would require retrofitting the cutouts of the existing panel or countertop or completely replacing the panels to realize the needed space. Other adjustable cup dispensers in the prior art are equally unsuitable for similar reasons, or the adjusting mechanisms are inaccessible on the front of the tube, or they are too complex and difficult to adjust.

Accordingly, it is an object of the present invention to provide a cup dispenser suitable for holding and dispensing a wide range of large cup sizes which can be mounted with a minimum of panel space, which can be readily adjusted for various size cups from the front of the panel with the fingers of the hand, and which can be tightly locked at the adjusted position. Another object of the invention is to provide an adjustable cup dispenser for a range of cup sizes in which the large cups can be accommodated in a relatively narrow dispenser. Another object is to provide a cup dispenser having adjustable retainers for controlling the discharge of cups from a stack in which the retainers cannot be inadvertently removed or displaced when the dispenser is flush-mounted in a panel or enclosure, which can be inexpensively manufactured almost entirely of molded plastic materials, and which is relatively easy to assemble, operate and maintain.

Briefly, these and other objects of the invention are accomplished with a novel and improved cup dispenser adjustable for dispensing a wide range of cup sizes, including the new jumbo size, from a storage tube in which they are stacked with their open end facing inward. The discharge end or front of the tube includes a flange or ring for flush-mounting on a panel. At least three retainers radially slidable within the flange frictionally engage the rim of the first cup to be discharged as the weight of the cups or a spring-biased cup pusher within the tube, or both, urges the entire stack outward. Each retainer includes at least one tooth intermeshing with a groove of a serrate surface within the flange at a selected position, and thumbscrew extending through slots in the flange lock them in place. The shank of each thumbscrew includes means for preventing the thumbscrew from being inadvertently removed.

Other objects, advantages and novel features of the invention will become apparent from the following detailed description of the invention when considered in conjunction with the accompanying drawings.

BRIEF DESCRIPTION OF THE DRAWINGS

FIG. 1 represents an adjustable jumbo cup dispenser according to the invention mounted in a panel and viewed from the front or discharge end;

FIG. 2 is a longitudinal view partly in cross section of the dispenser of FIG. 1 containing several cups;

DESCRIPTION OF THE PREFERRED EMBODIMENTS

Figure 3:
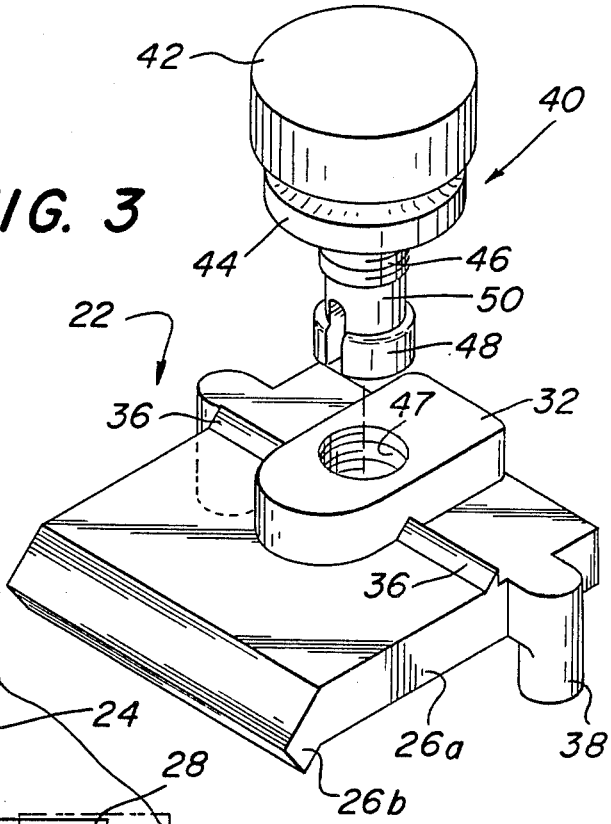
FIG. 3 is an exploded isometric view of a retainer used in the dispenser of FIG. 1.
Figure 5:
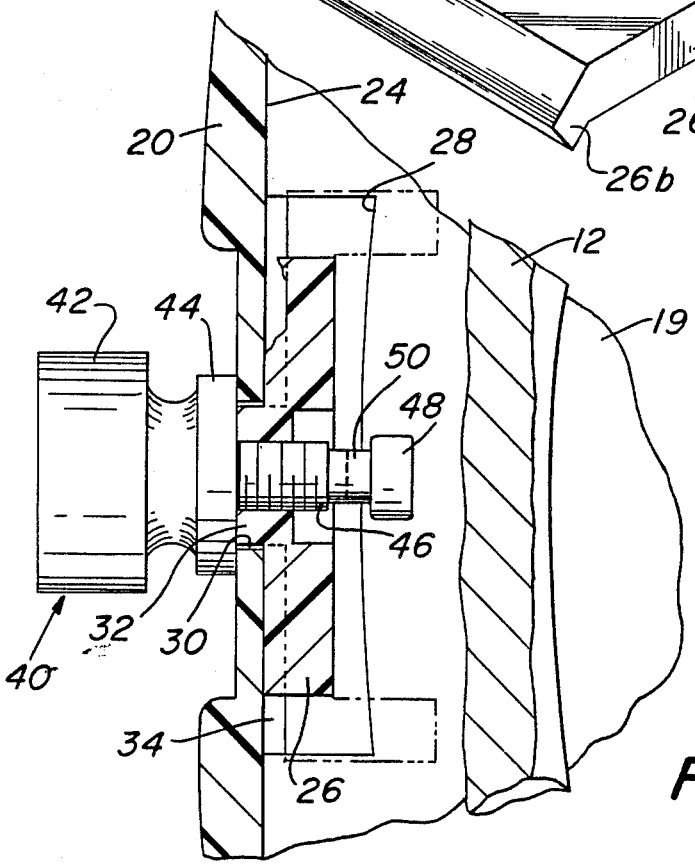
FIG. 5 is a transverse view of the retainer taken in cross section along the line 5—5 of FIG. 4.

Referring now to the drawings wherein like characters designate like or corresponding parts throughout the several views, there is shown in FIGS. 1 and 2 an adjustable cup dispenser 10 flush-mounted in a support panel 12, such as a countertop. The dispenser 10 may be supported on the panel in various ways with brackets and fasteners, not shown. Dispenser 10 includes an elongate circular magazine or storage tube 14, preferably of molded plastic, closed at the rear **14*a* and open at the front 14*b* for loading a stack of plastic or paper conical cups C with their open ends facing inwardly. The inside diameter of tube 14 is sized to handle the largest cup anticipated including the so-called jumbo cup. The cups C are loaded in tube 14 against a pressure head or cup pusher 16 which slides within and along the length of tube 14 and is biased outwards by a coil spring 18. The force of spring 18 is determined by the attitude and weight of the stack of cups C in tube 14 and a frictional retention force as described hereinafter. Obviously, a dispenser 10** discharging vertically downward would require a lighter spring than one discharging vertically upward for the same retention force.

The front end **14*b* of tube 14 fits into a collar 19 which projects from a concentric flange 20 and extends through a hole or cutout 12*a* in panel 12. The inner perimeter 21 of flange 20 overlaps the outer perimeter of pusher 16 to prevent pusher 16 from escaping from tube 14. The front surface of pusher 16 is slightly convex to provide self-centering of the stack at the rear of tube 14 while minimizing the amount it will protrude beyond flange 20** when all of the cups have been dispensed.

Dispenser 10 also includes three cup retainers 22 spaced 120 degrees apart around ring 20 for restricting cup discharge from tube 14. At least three retainers 22 are preferred for maintaining coaxial alignment of the stack of cups with tube 14. Obviously fewer retainers can be used but with a higher possibility of skewing and jamming the cups. Retainers 22 are nested within a recess 24 formed on the rear or inner face of flange 20 between collar 19 and the outer periphery of flange 20. Each retainer 22 is preferably constructed of molded plastic and includes a tab 26 registering with a port 28 in collar 19 adjacent to the inner face of flange 30, and a radial slot 30 in the face of flange 20. Tab 26 is substantially a flat section 26a terminating at the inner end in a beveled section 26b tilted inwardly for frictionally engaging the adjacent cup without snagging. Slot 30 is open at the inner periphery of flange 20 and terminates at the outer boundary of recess 24. A boss 32 centrally located on section 26a of tab 26 projects into the slot 30 to guide the tab 26 through port 28. The inner face of flange 20 on either side of slot 30 has a serrations 34 with its notches normal to the length of slots 30, and the confronting surface or tab 26 has a tooth 36 on either side of boss 32 for meshing with one of the notches in serrations 34 depending on the adjusted radial position of tab 26. The amount of adjustment is a function of the frictional retention force at the cup C by tabs 26 and the net discharge force exerted by the cups and spring 18. That is, the tabs 26 must impart a retention force slightly exceeding the discharge force at maximum deflection of spring 18 such as when tube 14 is fully loaded with cups. Maximum outward adjustment of tab 26, however, is limited by the outer boundary of recess 24, and maximum inward adjustment by studs 38 which protrude from tab 26 for engaging collar 19 below port 28. Studs 38 also prevent retainers 22 from being removed or falling out after the dispenser 10 is installed in panel 12.

Tooth 36 is retained in mesh with serrations 34 by a thumbscrew 40 which includes a knob 42 with an adjacent flange 44 overlapping the sides of slot 30. External threads 46 on the shank below flange 44 engage corresponding internal threads 47 in boss 32 and draw tooth 36 into one of a selected groove of serrations 34 for locking engagement. The shank terminates with a split detent 48 separated from threads 46 by a reduced diameter neck 50 for preventing thumbscrew 40 from being removed inadvertently after it us unthreaded from tab 26. That is, the opposed sides of the detent 48 normally cannot pass freely through the threaded hole of tab 26, but when pulled or pushed they compress and pass through.

Figure 6:
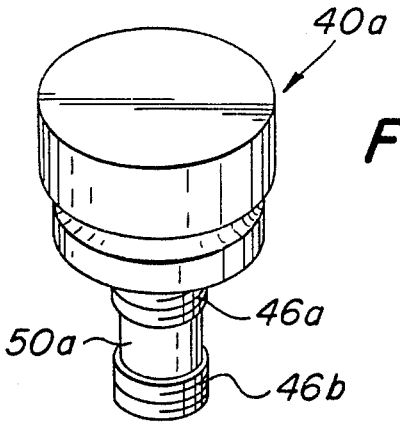
FIG. 6 is an alternate embodiment of a thumbscrew for the retainer of FIG. 3.
Figure 4:
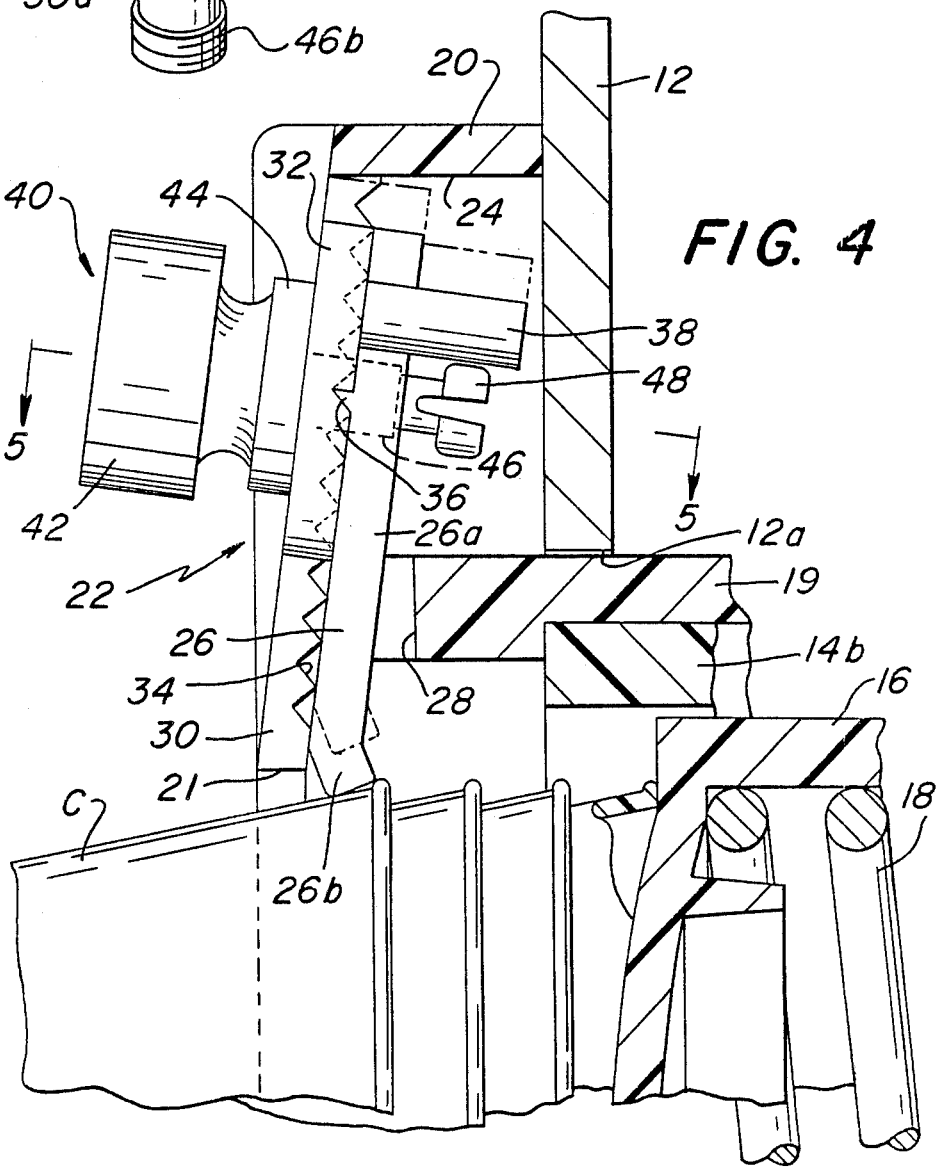
FIG. 4 is a side view of the retainer taken in cross section along the line 4—4 of FIG. 1.

Another embodiment of a thumbscrew 40a for preventing unintentional removal from retainer 22, is illustrated in FIG. 6. The shank of thumbscrew 40a includes external threads 46a and 46b, corresponding to internal threads 47 in boss 32, threads separated by a reduced diameter neck 50a. Thus, when thumbscrew 40a is unthreaded at threads 46a from tab 26, it is necessary to re-engage threads 46b and continue unthreading before thumbscrew 40a can be removed.

Operation of the jumbo dispenser according to the invention may be summarized as follows. The dispenser 10 is flush-mounted and secured by conventional means in a cutout in support panel 12 sized to accept storage tube 14 and collar 19 up to the rear surface of flange 20. Thumbscrews 40 are loosened to clear tooth 36 from serrations 34 therey allowing tab 26 to be moved outwardly while a stack of cups is loaded into tube 14 with their open ends facing inwardly. The innermost cup self-centers on the convex surface of pusher 16 and compresses spring 18 until tube 14 is fully loaded. Holding the stack in the tube with one hand, the tabs 26 are moved inwardly in substantially equal amounts for centering the cups with just sufficient pressure against the rim of the outer cup to overcome the discharge force due to the weight of the cups and/or due to spring 18 when compressed by the fully loaded stack of cups. Thumbscrews 40 are then tightened to urge tooth 36 in the coinciding notch of serrations 34 thereby locking tabs 26 in place.

Some of the many advantages and novel features of the invention should now be readily apparent. For example, a dispenser for jumbo cups is provided which can be installed in panels or countertops fitted for dispensers of smaller cups. The dispenser can be manually adjusted for different size cups from the front of the panel and tightly locked in position with the fingers of the hand and without tools. The locking mechanism is caged within the dispenser to prevent it from being inadvertently removed or displaced after the dispenser is flush-mounted in a panel. The dispenser can be manufactured almost entirly of molded plastic materials, and is relatively easy to assemble, operate and maintain.

It will be understood that various changes in the details, steps and arrangement of parts, which have been herein described and illustrated in order to explain the nature of the invention, may be made by those skilled in the art within the principle and scope of the invention as expressed in the appended claims.

What is claimed is:

1. A dispenser for paper cups and the like comprising, in combination:

tube means formed to fit in a panel cutout and to receive a nested stack of the cups for discharging from one end thereof, said tube means having a continuous unobstructed interior surface;

flange means fixed to said one end having a central opening coaxial with said tube means for flush mounting around the panel cutout, said flange means including radial slots communicating with the central opening and closed on the outside periphery thereof;

tabs radially slidable in respective ones of said slots from a position completely withdrawn from the central opening to an extended position within said opening for frictionally engaging the rim of the cups; and fasteners coupled to said tabs and said flange means for locking said tabs in either one of said positions.

2. A dispenser according to claim 1, wherein:

said fasteners each includes a thumbscrew with a shank threadingly engaged in respective ones of said tabs for locking said tabs at the selected positions, and a detent at the end of said shank for preventing inadvertent removal thereof from said tab.

3. A dispenser according to claim 2, wherein:

said detent includes a resilient bifurcated boss for resistively passing through the threaded section of said tab.

4. A dispenser according to claim 2, wherein:

said detent includes a threaded boss for engaging the threaded tab.

5. A cup dispenser comprising, in combination:

a hollow elongate cylinder for receiving a nested stack of cups, said cylinder being closed at one end and open at the other end for discharging the cups, said cylinder having a continuous unobstructed interior surface;

a cylindrical pusher slidable within and along the length of said cylinder;

a spring within said cylinder operatively connected between the closed end of said cylinder and the pusher for urging the cup toward the discharge end of said cylinder;

an annular flange having a cylindrical collar with spaced apart ports, the cylindrical collar extending from the rear face of the flange and coaxially secured about the discharge end of said cylinder for sliding into a cutout of a support member, said flange including radial slots communicating with the central opening and closed on the outside periphery thereof, and a serrate surface on the rear of said flange with notches normal to the length of respective ones of said slots; and a plurality of retainers movable along said slots and lockably connected to the rear serrate surface of said flange at positions registering with said ports and radially extendable from a position completely withdrawn from the central opening of said flange to an extended position within the central opening for frictionally engaging the rim of a cup.

6. A dispenser according to claim 5, further comprising:

a fastener threadingly connected between respective ones of said retainers, each having a thumbscrew on the front of said flange and a shank threadingly connected to said fastener.

7. A dispenser according to claim 6, wherein:

said shank terminates in a fiburcated boss for retaining said fastener in said retainer.

8. A dispenser according to claim 6, wherein:

said shank terminates in a member threadable through the associated retainer.

9. A dispenser for paper cups and the like comprising, in combination:

tube means formed to fit in a panel cutout and to receive a nested stack of the cups for discharging from one end thereof;

flange means fixed to said one end including a central opening coaxial with said tube means for flush mounting around the panel cutout, radial slots communicating with said central opening and closed on the outside periphery thereof, and a serrate surface along the length of each of said slots with notches normal thereto; and retainer means adjustably extending from and into said central opening for frictionally engaging the rim of said cups and including tabs each having a boss slidable in respective ones of said slots and a tooth for registering with a selected one of said notches, and fasteners each having a thumbscrew with a shank threadingly engaged in respective ones of said tabs for locking said tooth in the respective notches at selection positions, and a detent at the end of said shank having a resilient bifurcated boss for resistively passing through the threaded section of said tab for preventing inadvertent removal thereof from said tab.

10. A dispenser for paper cups and the like comprising, in combination:

tube means formed to fit in a panel cutout and to receive a nested stack of the cups for discharging from one end thereof;

flange means fixed to said one end including a central opening coaxial with said tube means for flush mounting around the panel cutout, radial slots communicating with said central opening and closed on the outside periphery thereof, and a serrate surface along the length of each of saidt slots with notches normal thereto; and retainer means adjustably extending from and into said central opening for frictionally engaging the rim of said cups and including tabs each having a boss radially slidable in respective ones of said slots and a tooth for registering with a selected one of said notches, and fasteners each including a thumbscrew with a shank threadingly engaged in respective ones of said tabs for locking said tooth in the respective notches at selection positions, and a detent at the end of said shank having a threaded boss for engaging the threaded tab for preventing inadvertent removal thereof from said tab.

11. A cup dispenser comprising, in combination:

a hollow elongate cylinder for receiving a nested stack of cups, and said cylinder being closed at one end and open at the other end for discharging the cups;

a cylindrical pusher slidable within and along the length of said cylinder;

a spring within said cylinder operatively connected between the closed end of said cylinder and the pusher for urging the cup toward the discharge end of said cylinder;

an annular flange including a cylindrical collar with spaced apart ports extending from the rear face and coaxially secured about the discharge end of said cylinder for sliding into a cutout of a support member, radial slots communicating with the central opening and closed on the outside periphery thereof, and a serrate surface on the rear of the flange with notches normal to the length of respective ones of said slots;

a plurality of retainers lockably connected to the rear of said flange at positions registering with said ports for radially extending into the central opening of said flange for frictionally engaging the rim of a cup, and said retainers each including a boss slidable in respective ones of said slots and a tooth registering with a selected one of said notches; and a fastener operatively connected between respective ones of said retainers, each having a thumbscrew on the front of said flange and a shank threadingly connected to said fastener and terminating in a bifurcated boss for retaining said fastener in said retainer.

12. A cup dispenser comprising, in combination:

a hollow elongate cylinder for receiving a nested stack of cups, and said cylinder being closed at one end and open at the other end of discharging the cups;

a cylindrical pusher slidable within and along the length of said cylinder;

a spring within said cylinder operatively connected between the closed end of said cylinder and the pusher for urging the cup toward the discharge end of said cylinder;

an annular flange including a cylindrical collar with spaced apart ports extending from the rear face and coaxially secured about the discharge end of said cylinder for sliding into a cutout of a support member, radial slots communicating with the central opening and closed on the outside periphery thereof, and a serrate surface on the rear of the flange with notches normal to the length of respective ones of said slots;

a plurality of retainers lockably connected to the rear of said flange at positions registering with said ports for radially extending into the central opening of said flange for frictionally engaging the rim of a cup, said retainers each including a boss slidable in respective ones of said slots, and a tooth registering with a selected one of said notches; and a fastener operatively connected between respective ones of said retainers, each having a thumbscrew on the front of said flange and a shank threadingly connected to said fastener and terminating in a member threadable through the associated retainer.

* * * * *